United States Patent [19]

Congelliere

[11] 4,055,736

[45] Oct. 25, 1977

[54] PUSH SWITCH

[76] Inventor: Peter Congelliere, 3321Yale, Santa Ana, Calif. 92704

[21] Appl. No.: 641,734

[22] Filed: Dec. 18, 1975

[51] Int. Cl.[2] ..... H01H 13/04

[52] U.S. Cl. ..... 200/16 A; 200/159 R

[58] Field of Search ..... 200/159 R, 159 B, 237, 200/238, 293, 303, 16 A

[56] References Cited

U.S. PATENT DOCUMENTS 3,829,633 8/1974 Smith et al. ..... 200/16 A

*Primary Examiner*—Herman T. Hohauser

*Attorney, Agent, or Firm*—Grover A. Frater

[57] ABSTRACT

A push-button, actuated electric switch is formed with a pair of flat, C-shaped fixed contacts which define an annulus, discontinuous at diametric points, the outer margins of which are clamped firmly between conformations in an upper and lower section of the switch housing. The fixed contacts are bridged to accomplish switching action by the circular perimeter of a moveable contact which is moved toward and away from the inner periphery of the annulus formed by the C-shaped contacts. A tab extending from an edge of each of those fixed contacts extends within a passageway formed in the housing where the tab is bonded to the end of an electrical conductor. The tab and conductor are free to bend and vibrate within the passageway without affecting the position of the portions of the fixed contactor that define the discontinuous annulus whereat mounting and bridging contact are accomplished.

12 Claims, 7 Drawing Figures

PUSH SWITCH

BACKGROUND OF THE INVENTION

This invention relates to improvements in electric switches, and it relates particularly to improvements in push-button switches.

While not limited thereto, the invention is particularly applicable to push-button switches of a kind in which a plunger is mounted for reciprocation within the switch housing. Part of the plunger extends from the housing and is urged to that extended position by an internal bias spring. Upon depressing the plunger, the switch is actuated, and when it is released, the bias spring returns the actuator to initial extended position, without reactuating the switch.

Both the plunger, at a point inside the housing, and the housing itself, are formed with cam surfaces that cooperate with cam follower surfaces that are formed on a ratchet. The ratchet is moveable relative to the plunger and to the housing, and it is moved in one direction by depression of the plunger. In a common form, the bias spring acts both on the ratchet and on the plunger to return them after depression of the plunger. The cam surfaces are arranged so that the ratchet is made to rotate, or index, through an angle of rotation perpendicular to the axis of the plunger and ratchet reciprocation.

The cam surfaces are arranged so that the ratchet comes to rest at one of two positions in the direction of its axial movement. Those two positions are assumed alternately as the switch plunger is pressed successively. The ratchet is made to bear upon a moveable contact of the switch, and in one ratchet position the moveable contact is held away from the fixed contacts of the switch, and in the other axial position of the ratchet the moveable contact is permitted to engage the fixed contacts of the switch.

That kind of a mechanism lends itself to inclusion in the cylindrical mounting stem of what the industry calls a "one-hole mounting switch." Units of that kind have gained wide acceptance as power control switches for a wide variety of small electrical appliances. That wide acceptance can be accounted for by the fact that such switches can be produced at low cost and because the push-button indexing mechanism can easily be made long-lived and reliable. However, the reliability of the electrical operation of such switches has not matched the reliability of the push-button ratcheting structure. Heretofore, attempts to improve electrical reliability have been accomplished only at increased manufacturing costs.

SUMMARY OF THE INVENTION

It is an object of this invention to provide an electrical switch of the push-button variety which permits a higher degree of reliability than has been achieved in prior switches of this class, and it is a related object to achieve that reliability at reduced cost.

Reliability in operation of the moveable contact is relatively easy to accomplish. It can be mounted so that it has several degrees of freedom of motion, and that motion can be made to compensate for minor changes in contact dimensions. The requirements for reliability can be met by using a cup which is free to reciprocate within the ratchet and plunger structure. The moveable contact is formed as a flange which extends from the rim of the cup. The invention uses a flange-on-flange construction to insure proper mechanical operation of the moveable contact while permitting an even greater latitude in the thickness of the material from which the cup is formed, and in other dimensions of the cup.

Rather than the moveable contact, it is the reliability of the fixed contact construction that has required improvement. Failure results from displacement of the fixed contact from its intended position, or it has resulted from a mechanical failure of the connection between fixed contact and the external power conductor. In general, the incorporation of a separate fastening structure to hold the fixed contact relative to the switch housing or base, and the use of a separate fastening element to secure the power conductor to the fixed contact, is precluded because of the high cost of such devices. That cost can arise out of the need for dimensional control in the case of automatic assembly, or the cost of direct labor in the case of manual assembly. Prior switch designs have resolved the matter by forming contacts of resilient materials, forming them into spring shape, and then utilizing their renitance to trap them into cavities and conformations formed in the switch housing or base. The need to minimize costs, coupled with the demand for switches in the small physical size, results in switch contacts that are very small. As a consequence, changes in the thickness or the resilient quality of the raw materials from which the fixed contacts are fabricated results in a wide range of performance characteristics. In prior constructions, a "stiff" spring action was desirable to keep the fixed contact in place, but that stiffness resulted generally in increased failure of the connection between the external conductor and the fixed contact as an incident to vibration or simple handling of the external conductors.

The invention uses a flat, fixed contact which is held in place, not by its resilience but by entrapment between separate sections of the switch housing. The contacts are made with an extension that is not trapped and which has resilience to yield easily to vibration whereby the reliability of the connection between that fixed contact and the external conductor is improved.

DESCRIPTION OF THE PREFERRED EMBODIMENT

Figure 1:
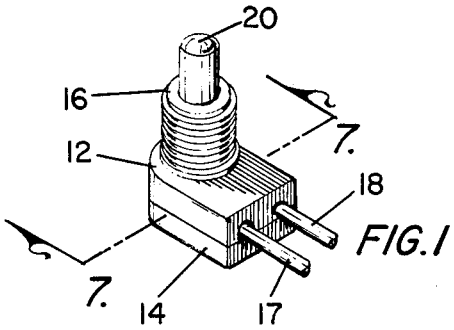
FIG. 1 is an isometric view of a switch which embodies the invention.
Figure 6:
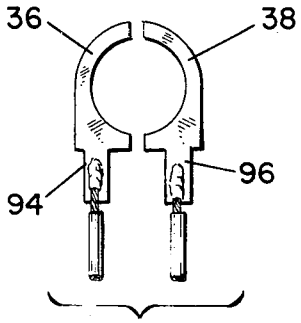
FIG. 6 is a top plan view of the fixed contact elements of the invention.

The preferred embodiment of the invention is shown in FIG. 1. It includes a housing 10 formed by an upper section 12 and a lower section 14. A cylindrical, externally threaded, switch mount and plunger guide 16 extends upwardly from the upper surface of the upper housing section 12. The housing is generally arch-shaped in top plan view. The arch portion is formed on a circular curve which forms a semi-circular extending from one side of the arch to the other. The arch sides are parallel. The bottom of the arch marks the end of the switch. Two passageways are formed in the upper housing section and are open at that end face of the switch. One of a pair of conductor wires 17 and 18 extends into a respectively associated one of those passageways.

The switch operator is a plunger structure, the plunger portion 20 of which is visible in the figure.

Figure 2:
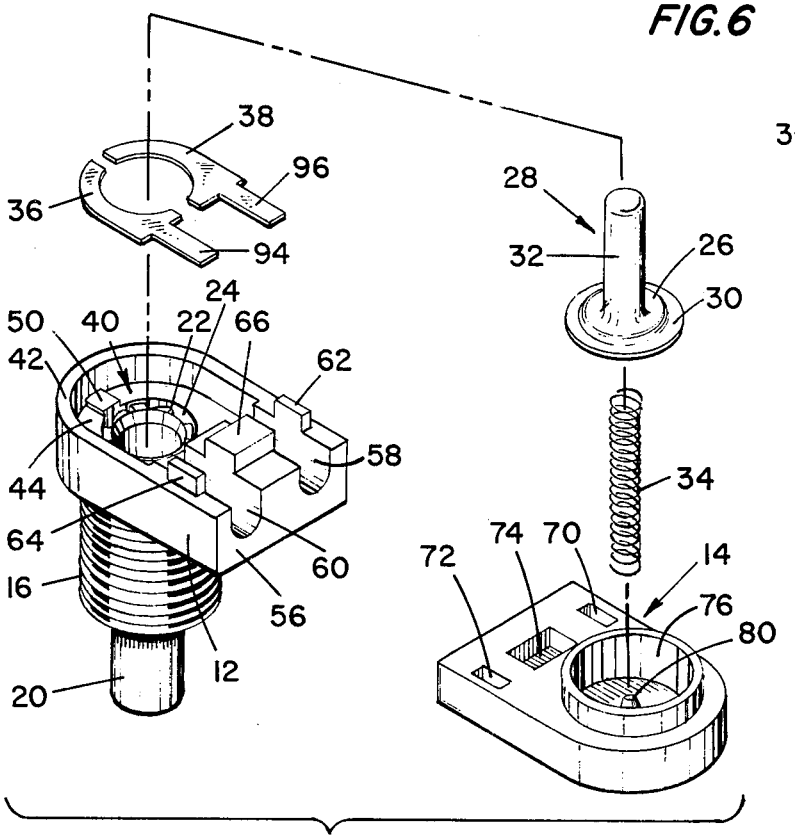
FIG. 2 is an exploded view showing the several parts of the switch of FIG. 1.
Figure 7:
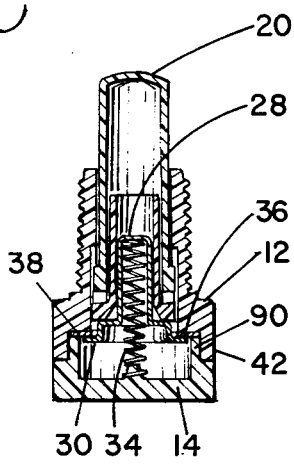
FIG. 7 is a cross-sectional view of the switch of FIG. 1, the section being taken on line 7—7 of FIG. 1.

The plunger structure includes a plunger 20 and a ratchet 22, a small portion of which is visible in FIG. 2, and a cross-section of which is shown in FIG. 7. The ratchet structure is a generally cylindrical, deep cup, the rim of which is formed with cam surfaces that cooperate with cam surfaces of the plunger and housing. The cup of the ratchet is telescoped into a cylindrical recess in the lower end (upper end in FIG. 2) of the plunger 20, and together the ratchet and plunger are mounted for reciprocation in a generally cylindrical opening that extends axially through the mounting stem and guide 16 of the housing. Cam surfaces on the inner wall of the opening 24 and on the end of the plunger 20 cooperate to make the ratchet rotate, or index, through a rotational angle each time that the plunger 20 is depressed.

Figure 3:
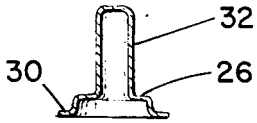
FIG. 3 is a cross-sectional view taken in the plane of its axis of the moveable contact cup.

That structure forms no part of the invention. It is shown, and may be understood by, an examination of U.S. Pat. No. 3,694,603. It is important here only to note that the end of the ratchet 22 bears against the inner most flange 26 of a cup-shaped member 28 whose outer flange 30 serves as the moveable contact of the structure. That cup is shown in cross-section in FIG. 3. It is formed of a conductive material, advantageously metal, or at least having the upper surface of its flange 30 covered with a metallic substance. The cup member is assembled with its cup 32 telescoped into a circular recess within the ratchet 22.

A coiled compression spring 34 bears at its lower end against a lower housing member 14. Its upper end extends into the cup 22 of the cup member 28. It bears against the bottom wall of the cup forcing the cup up (down in FIG. 2) into the ratchet member 22 so that the inner flange 26 bears against the inner rim of the ratchet. As a consequence, the ratchet is pushed upwardly in FIGS. 1 and 7, and downwardly in FIG. 2, in the opening 24. The ratchet bears against the plunger 20, as best shown in FIG. 7, and forces the plunger to full extension from the mounting stem 16.

Figure 4:
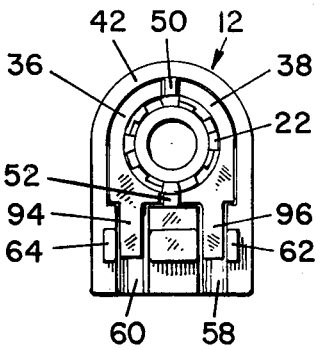
FIG. 4 is a bottom plan view of the upper part of the switch housing.
Figure 5:
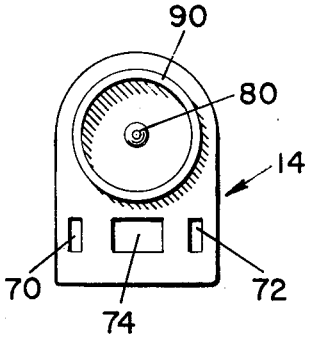
FIG. 5 is a top plan view of the bottom portion of the switch housing.

The fixed contacts are C-shaped structures, one designated 36 and the other designated 38. Those fixed contacts are disposed in a recess which is formed in the lower face of the upper housing member 12. The recess is best shown in FIG. 2 and the manner in which the fixed contacts are disposed in the recess is shown in FIG. 4 and in FIG. 7. Returning to FIG. 2, the recess 40 is generally arch-shaped and it is formed as a depression in the lower face of upper housing member 12 such that there is an arch-shaped wall 42 standing up at the edges of the bottom wall 44 of the recess. The two C-shaped fixed contact elements 36 and 38 have a combined shape corresponding to the shape of bottom wall 44. The C openings of the two contact elements face one another and form a circular opening. Indeed, they define an annulus of conducting material which is separating at diametric points (along the center line of the arch-shape they describe) so that they can be electrically insulated one from the other. Two upstanding projections, designated 50 and 52 in FIG. 2, extend up from the recess and fit in the space between the two C-shaped elements to insure that they cannot touch one another.

Together, the C-shaped elements form a circular opening into which the end of ratchet 22 and the inner flange 26 of the cup member 28 can be disposed without touching either of the C-shaped elements. The upper surface of flange 30 constitutes an annular moveable bridging structure which can, and when the switch is enclosed, does, engage the annular portion of the C-shaped contact elements 36 and 38 to bridge those elements.

The arch-shaped recess 40 does not extend over the whole of the housing face in which it is formed. The portion of the upper housing between the recess 40 and the end face 56 is divided into three sections by a pair of spaced recesses 58 and 60 which extend parallel to one another and to the side walls of the housing face. Those recesses, 58 and 60, open at the end face 56 of the housing and they extend to the recess 40. In the assembled housing, recesses 58 and 60 form passageways that afford communication from the exterior of the housing to the C-shaped contact elements.

The recesses 58 and 60 divide the lower face of the housing member 12 adjacent to end 56 into three sections each of which is formed with an upstanding boss, the two outer ones of which are designated 62 and 64, and the central one of which is designated 66. Those three bosses, 62, 64, and 66, fit into recesses 70, 72, and 74, respectively, formed in the upper face of the lower body section 14.

The lower body section is formed with a circular recess 76, the axis of which is coincident with the axis of opening 24 and with the axis of the semi-circular part of wall 42 of the upper housing member 12. A projection 80 extends upwardly from the bottom wall of recess 76 on that axis. The projection forms a locating pin for the compression spring 34. A cylindrical wall 90, extending upwardly from the upper face of the lower body member 14, is concentric with recess 76 and, in this embodiment, the inner diameter of the cylindrical wall is the same as the inner diameter of the recess 76. Wall 90 is as high as recess 40 of the upper body section 40 is deep, less slightly more than the thickness of the fixed C-shaped contact elements 36 and 38. In the assembled unit, the upper and lower housing sections are bonded sonically, and in that bonding process, the fixed contact elements 36 and 38 are clamped tightly between the upper surface of wall 90 of the surface 44 at the bottom of recess 40 of the upper housing section. The outer radius of wall 90 is substantially equal to the inner radius of wall 42 of housing section 12, and the thickness of wall 90 is substantially less than the width of the annulus formed by the combination of fixed contacts 36 and 38. That is best shown in FIG. 7. As a consequence, the wall 90 clamps the fixed contacts 36 and 38 in position by engaging only their outer margins. The inner portions of the annulus are exposed for engagement by flange 30 of the cup member 28.

As explained above, the plunger and ratchet are arranged such that the cup member 28 is moved so that flange 30 occupies one of two positions and so that those positions are occupied successfully with successive actuations of the plunger 20. In one position, flange 30 is in engagement with the fixed contacts 38 and 36, as shown in FIG. 7, and in the other position, the cup rim 30 is held at a position below the position it occupies in FIG. 7. In that lower position, it does not engage contacts 36 and 38. The cup portion 32 of cup member 28 has a diameter which is less than the inner diameter of the ratchet 22 into which it is telescoped. The cup member bears against the ratchet only at the surface of flange 26, and the force with which the cup bears against the ratchet is applied by spring 34 at the end wall or bottom wall of the cup which is removed in substantial degree from the inner flange 26. As a consequence, the cup member 28 and the flange 30 are free to tilt, if necessary, so that the flange 30 will lie firmly against both of the fixed contacts 36 and 38 in the switch closed position. On the other hand, the fixed contacts are trapped against movement, notwithstanding that they are formed of flat stock and unbent, and they are fixed without any resort to the resilient quality of the contact material. In fact, the contact material need not have a high degree of resilience. Indeed, the contacts can be formed of soft-drawn copper or brass.

Each contact has a tab extending from it. The tab extending from contact 36 is numbered 94, and the tab extending from contact 38 is numbered 96. Those tabs extend into recesses or passageways 60 and 58, respectively. They have a cross-sectional area less than the cross-sectional area of the passageways, and they have a thickness less than the thickness of the passageways so that the tabs may be bent up and down within the passageways after assembly of the switch. Before assembly, the stripped end of a conductor wire is bonded by soldering or welding to each of the tabs. The end of a conductor 97 is bonded to tab 94 and the end of a conductor 98 is bonded to tab 96. The combined cross-sectional dimension of the wire and in the tab is made less than the cross-sectional area of the passageways to the end that the tab may be bent after assembly out of the plane of the contract from which it extends. That feature is important because it permits bending and flexure of the tab in small degree without breaking and without fatigue failure in response to vibration and in response to manipulation of the conductor wires during installation of the switch and during operation and repair of the apparatus with which the switch is associated.

In the preferred embodiment, the housing and the ratchet and plunger are made entirely of an electrically non-conductive plastic. Only the cup member 28, the C-shaped fixed contacts and the conductors of the conductor wires are made of metal.

I claim:

1. In a switch of the kind that includes a pair of electrically conductive contact elements and a plunger structure having an electrically conducting bridging surface, and means responsive to an actuating force for causing the plunger to be displaced such that said bridging surface is caused during successive actuations to assume a first position bridging said contact element, and a second position in which said bridging surface is spaced from said contact elements, the improvement which comprises:

said contact elements comprising a pair of C-shaped members formed of sheet material disposed in a plane with the open portion of the C-shape of each facing the other such that togehter they define segments of an annulus incomplete at diametric points; and said bridging surface comprising a circular member having an outer diameter greater than the inner diameter of said annulus and less than the outer diameter of said annulus;

housing means in the form of a housing comprising a first housing member and a second housing member engaging respectively associated opoosite side of the outer peripheral portion of said annulus for retaining said C-shaped members in said plane and for guiding movement of said plunger structure.

2. The invention defined in claim 1 which further comprises a pair of insulating spacers disposed at the points at which said annulus is incomplete.

3. The invention defined in claim 2 in which said housing is formed with a pair of passageways extending from the exterior to the interior thereof adjacent to respectively associated ones of said C-shaped members; and in which said contact element further comprise a pair of tabs, one extending laterally from each of said C-shaped members into the passageway associated with the C-shaped member from which it extends, each tab having a thickness less than the dimension across the passageway into which it entends such that each tab may be bent, within its passageway, in the direction of its thickness.

4. The invention defined in claim 3 which further conprises a pair of electrically conductive wires one extending into each of said passageways and each having an end bonded to the tab in its respectively associated passageway.

5. The invention defined in claim 4 in which the sum of the transverse cross-sectional area of said wires and the transverse cross-sectional area of said tabs is substantially less than the transverse cross-sectional area of the passageway in which the wire and tab are disposed whereby the space in said passageways is sufficient to permit flexure of said tabs after being bonded to said conductors.

6. The invention defined in claim 4 which further comprises means in the form of a coiled compression spring for urging said bridging surface toward said contact elements.

7. The invention defined in claim 1 in which said first housing member has an upper surface formed with a circular recess surrounded by an upstanding cylindrical sleeve of insulating material and in which said second housing member has a lower surface formed with a downwardly extending, arch-shaped skirt the arcuate portion of the arch of which is semi-circular and has an inside radius corresponding to the outer radius of said upstanding cylindrical sleeve of said frist housing member, said first and second housing members being assembled with their upper and lower faces toward one another, respectively, with said C-shaped contact elements clamped between them such that said contact elements lie within the skirt of said second housing member over the cylindrical sleeve of said first housing member with a center of the annulus substantially concentric with the axis of said circular recess in said lower housing member.

8. The invention defined in claim 7 in which said lower face of said second housing member is further formed with a projecting boss extending downwardly toward the upper face of said first housing member between the sides of said arch-shaped skirt whereby two passageways are defined extending from the exterior of said housing to the respectively associated ones of said C-shaped contact elements.

9. Th invention defined in claim 8 in which each of said C-shaped contact elements if formed with a tab extending laterally therefrom into a separately associated one of said passageways.

10. The invention defined in claim 9 in which said housing is formed with projections extending from one of said first and second housing members between said C-shaped contact elements at said diametric points.

11. The invention defined in claim 10 which further comprises a pair of conductor wies having ends disposed in said passageways and thereby to respectively associated one of said tabs.

12. The invention defined in claim 11 in which said contact elements and tabs are formed of a metal and in which said tabs are of size relative to cross-sectional area of said passagemways such that said tabs are free to bend out of the plane of the C-shaped contact areas.

* * * * *